United States Patent [19]

Sime

[11] Patent Number: 4,914,834

[45] Date of Patent: Apr. 10, 1990

[54] GRAIN DRYER

[76] Inventor: Sylvan H. Sime, P.O. Box 38, Walters, Minn. 56092

[21] Appl. No.: 336,135

[22] Filed: Apr. 11, 1989

[51] Int. Cl.[4] ..... F26B 17/12

[52] U.S. Cl. ..... 34/169; 34/174

[58] Field of Search ..... 34/174, 169, 236, 165, 34/54, 65

[56] References Cited

U.S. PATENT DOCUMENTS

| | | | |
|---|---|---|---|
| Re. 25,230 | 8/1962 | Pierpoint | 34/55 |
| Re. 27,573 | 2/1973 | Kucera | 34/20 |
| 2,654,590 | 10/1953 | Molenaar | 263/30 |
| 3,233,337 | 2/1966 | Tomlinson | 34/65 |
| 3,333,348 | 8/1967 | Ausherman et al. | 34/170 |
| 3,440,734 | 4/1969 | Batterton et al. | 34/65 |
| 3,474,903 | 10/1969 | Ausherman | 209/11 |
| 3,896,562 | 7/1975 | Zimmerman | 34/174 |
| 4,118,875 | 10/1978 | Sietmann et al. | 34/174 |
| 4,289,481 | 9/1981 | Yano | 432/96 |
| 4,308,669 | 1/1982 | Noyes et al. | 34/33 |
| 4,337,584 | 7/1982 | Johnson | 34/65 |
| 4,446,631 | 5/1984 | Batterton et al. | 34/65 |

*Primary Examiner*—Henry A. Bennet
*Attorney, Agent, or Firm*—Kinney & Lange

[57] ABSTRACT

A grain column dryer which includes two concentric, cylindrical pervious walls and a pervious cone on top of the inner pervious wall, utilizes an impervious, heat insulated, cylindrical outer wall spaced outwardly from the pervious walls. A heater/blower assembly is supported on a substantially airtight impervious bulkhead in the center of the dryer to force heated air into an upper heated plenum and out through the concentric pervious walls and the pervious top cone, and to thereby draw air through lower portions of the pervious walls. A hottest air recycle collar is attached to the outer pervious wall above the bulkhead baffle and extends, in spaced relation to the outer pervious wall and to the outer impervious wall, to position well below the bulkhead baffle. The impervious outer wall terminates short of the bottom of the pervious walls so that heated air passes from above the bulkhead baffle down inside of the recycle collar and inside of the impervious outer wall and back through the pervious walls below the baffle to mix with ambient air drawn in through the pervious walls below the impervious outer wall.

14 Claims, 5 Drawing Sheets

82
80
10
24
50
16
69
225
65
100
102
46
110
46
18
20

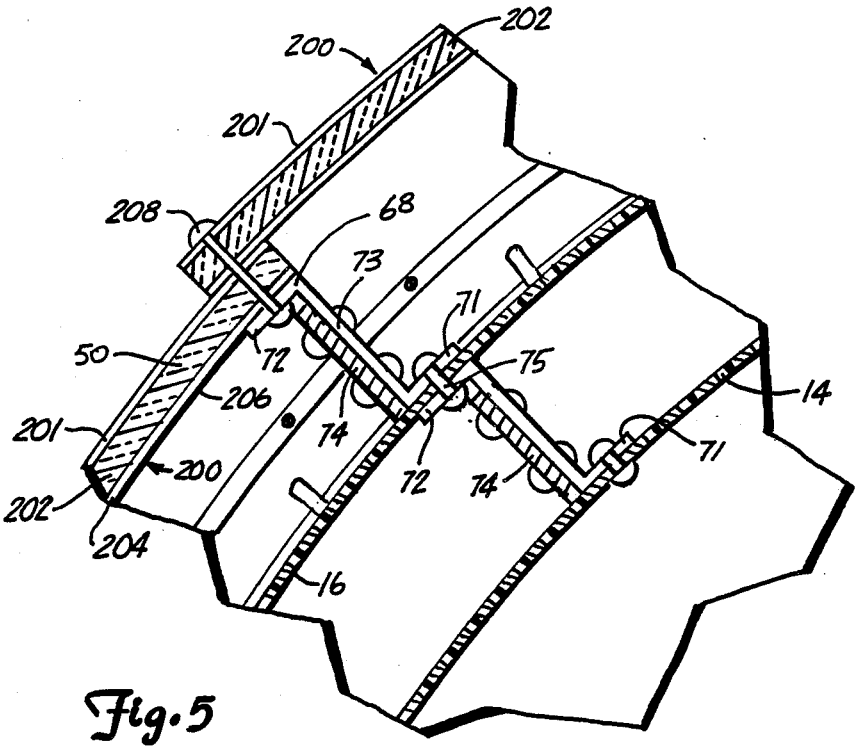
Fig. 5
Fig. 6
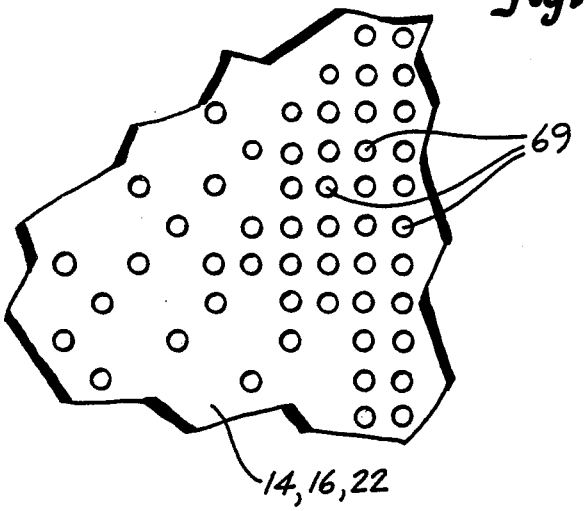

GRAIN DRYER

BACKGROUND OF THE INVENTION

1. Field of the Invention.

This invention has relation to continuous flow grain dryers of the type wherein a column of grain to be dried and conditioned is formed between a pair of concentric, spaced-apart, pervious ring-like walls encircling a heater/blower assembly. This assembly heats and blows air into an upper plenum inside the inner wall. This hot air passes out through the pervious walls to heat and dry the grain, drawing cooling air into a lower plenum inside the inner wall and separated from the upper plenum by a baffle plate which surrounds the heater/-blower assembly.

2. Description of the Prior Art.

It is conventional to utilize concentric, cylindrical pervious walls in grain column dryers which pass heated air outwardly through an upper plenum and which utilize cooling ambient air passing through the portion of the dryer horizontally aligned with a cooling plenum. Such structures are shown in U.S. Pat RE 25,230 to Pierpoint originally granted on Jul. 11, 1961; U.S. Pat. 3,440,734 to Batterton et al granted on Apr. 29, 1969; and U.S. Pat. 4,446,631 to Batterton et al, granted on May 8, 1984.

One effective way to accomplish this air flow is to suck the air in through a lower cooling section of concentric walls, to heat this air in the center of the dryer and then force the air out through the walls aligned with the heated plenum. See U.S. Pat. 2,654,590 to Molenaar, granted on Oct. 6, 1953; U.S. Pat. 3,233,337 to Tomlinson granted Feb. 1966; U.S. Pat. 3,333,348 to Ausherman et al granted on Aug. 1, 1967; U.S. Pat. 3,474,903 to Ausherman granted Oct. 28, 1969; and U.S. Pat. 3,896,562 to Zimmerman granted Jul. 29. 1975.

Grain dryers where a continuous flow of grain moves vertically as a grain column between two spaced-apart pervious walls and the heated drying air as well as the cooling air moves transversely through the grain column have been delineated generally as "crossflow grain dryers." In the middle 197O',s there was a switch from emphasis on performance of such high temperature grain dryers from improving dryer capacity to decreasing the energy consumption of the dryers. A paper on simulation results comparing the performance of three types of crossflow grain dryers was published and presented at the 1975 Annual Meeting of the American Society of Agricultural Engineers at the University of California-Davis, in Davis, California, June 22–25, 1975. The authors were Richard O. Pierce and Professor Thomas L. Thompson of the Agricultural Engineering Department of the University of Nebraska at Lincoln, Nebraska; and the paper was published by the American Society of Agricultural Engineers, St. Joseph, Michigan 49085. The title of the paper was *Energy Utilization and Efficiency of Cross Flow Grain Dryers.*

Of particular interest is FIG. 1 of this paper which presents a schematic diagram of the three crossflow dryer types studied. These three types are:

(a) "conventional crossflow dryer" typified by the patents cited above;

(b) "reversed crossflow dryer" in which, apparently, the upper portion of the grain column is dried by flow from one direction, say left to right through the vertically moving grain column, an intermediate section is dried by causing the hot air to flow in the opposite direction, say from right to left, and a bottom portion is subject to a crossflow from ambient air as a cooling stage; and (c) a dryer where heated air from a mixing chamber is forced through an upper section of a grain column and out to the atmosphere, other heated air is forced through an intermediate section in one direction, say from left to right, and is then recirculated back into that same section to flow in the reverse direction, say from right to left, this reverse flow are then passing back into the mixing chamber together with a flow of ambient air which has first passed through a bottom, cooling section.

The Pierce/Thompson paper reported that definite economies in energy utilization could be obtained by some recirculation of the drying air back through the grain column in a manner similar to that shown in FIG. 1*c*. No suggestions were made as to configuration of dryers to accomplish these improved results, however.

Three patents of which the present inventor is aware each show structure which utilized an impervious structure in surrounding relation to concentric pervious walls that encompass a grain column. In this way, some measure of recirculation of heat energy components was apparently achieved. These include U.S. Pat. No. 4,289,481 granted to Yano on Sept. 15, 1981; U.S. Pat. No. 4,308,669 granted to Noyes et al on Jan. 5, 1982; and U.S. Pat. No. 4,337,584 granted to Johnson on Jul. 6, 1982.

In the Yano patent, however, all that was "reclaimed" was, apparently, the fines which blew out through the pervious walls. These were separated in a cyclone and/or filter screen separator and fed back into the burner where they were consumed to add to the heat energy.

In much of the prior art cited above, an impervious cone "capped" the inner pervious wall, and grain to be dried was delivered to the top of that cone where it s-id down to a position between the inner and outer pervious walls. Two patents disclose portable crossflow grain dryers utilizing pervious cones where the outward flow of heated, moisture-laden air is not only through the vertical grain dryer portions but also through grain resting on top of the pervious cone. These are U.S. Pat. No. RE 27,573 to Kucera, originally issued Aug. 18, 1970; and U.S. Pat. No. 4,118,875 granted to Sietmann et al, on Oct. 10, 1978. The structure of each of these patents requires that a layer of grain lies on top of the pervious cone. If no such grain were present, then the heated air would rise out of the top of the cone without a substantial drying effect on the grain in the grain column.

While the Sietmann et al '875 patent shows a layer of grain lying on top of the pervious cone 18, neither that patent nor the Kucera patent suggests how that layer can be achieved and how it can be maintained at a level to permit uniform control over the drying process. In each patent it is apparently contemplated that grain will be added at a rate sufficient to keep most of the side board extending above the outer pervious wall pretty well filled to the top with grain so that the layer on top of the pervious cone is at all points at least as thick as the grain column itself.

An earlier patent to Sietmann, U.S. Pat. No. 3,479,748, granted on Nov. 25, 1969, discloses a batch grain dryer in which an "overhead floor structure indicated generally at 37 in FIG. 1" includes a pervious cone on which the batch of grain to be dried is directed, and a "drying apparatus indicated generally at 41 in FIG. 2". See Sietmann et al '748, paragraph beginning on column 3, line 51. This drying apparatus consists of a blower/heater 92 connected to an opening 91 just below the "overhead floor structure 37" and high up on a pervious cylindrical wall or side wall 13. See column 5, beginning on line 36 and FIGS. 2 and 1. Additionally, for introducing ambient air, "A blower system (not shown) is fluidly communicable with the trough 18 through a duct 22, and upon energizing the blower, air is forced into the trough 18 whereby it percolates upwardly up through the perforated floor plate 19 and through granular material stored thereon for aeration purposes." See column 3, beginning on line 24.

A series of cylindrical "upper bands 73, 74 and 76" and "lower bands 96, 97 and 98" are provided with adjustments "such that any particular amount of grain which is desirable to be dried at one time above the floor 42 can be so handled by this apparatus." Paragraph beginning on column 7, line 9.

This "raised floor" or "overhead floor structure" includes "a plurality of particularly placed openings formed therein, closed by a remote operator-controlled device whereby the grain, after drying, can be dumped in an even, level manner onto the base floor" See column 1, beginning on line 19.

From a consideration of the Sietman '748 patent and the above summary of it, it is evident that the grain is in a static position while it is being heated and dried by a relatively general upward flow of heated air introduced at a side of and beneath the "raised floor" or "overhead floor structure" After it has been dried, it "can be dumped in an even, level manner onto the base floor" while it is still hot and allowed to lie there on top of a "perforated plate 19 capable of holding granular material while enabling air from there below to pass upwardly therethrough." "A blower system (not shown) is fluidly communicable with trough 18 through duct 22, and upon energizing the blower, [cool, ambient]air is forced into the trough 18 whereupon it percolates upwardly through the perforated floor plate 19 and through granular materials stored thereon for aeration purposes." Column 3, lines 17 through 29. This upward flow of cooling air through static, hot, dried grain which lies evenly on the plate 19 is not part of the drying process, and one can presume that it is being carried out while the "raised floor" is being reloaded with the next batch of grain to be dried. No recycling of either the cooling air after it has passed through the grain lying on plate 19 nor of the heating air passing from the blower/heater 92 and out through the top of the pervious cone is contemplated, and all energy expended heating and blowing the drying air and the cooling air is lost as the air passes out of the top of the dryer.

The inventor and those in privity with him are aware of no prior art closer than that discussed above and are aware of no prior art which anticipates the claims set out herein.

SUMMARY OF THE INVENTION

A grain dryer and conditioner includes a base partially defined by a horizontal upper surface. A column of grain to be dried and conditioned is confined by a pair of ring-like, congruent, concentric, upright, spaced-apart, inner and outer pervious walls supported on the upper horizontal surface of the base. The inner wall terminates at a ring-like, generally horizontal upper end surface, and a top cone is positioned above this wall to direct grain deposited on it to flow by gravity to the space between the upright pervious walls. Means is provided to deliver grain to be dried and conditioned to fall on top of the top cone.

A grain side board extends upwardly from the outer pervious wall in position to support grain above the grain column so that grain falling from the top cone cannot get beyond the outer pervious wall.

An upwardly blowing heater/blower assembly includes an impervious outer duct which is supported by bulkhead means at an intermediate position between the top and bottom of the upright pervious walls in position within and concentric with those walls. The bulkhead means includes a bulkhead baffle extending between a ring-like portion of the heater/blower assembly duct and a ring-like portion of the inner upright pervious wall in position to tend to block the return flow of heated air from the top of the heater/blower assembly duct back to the bottom of the duct inside of the inner pervious wall. The presence of this bulkhead baffle creates within the inner upright pervious wall a positively pressured upper heated plenum above the bulkhead baffle and a relatively negatively pressured lower plenum below the bulkhead baffle.

The structure described above constitutes part of the prior art. The improvement to the prior art is set out below.

The top cone is pervious to allow heated air to pass through a grain layer on top of the cone to begin the heating of the grain and to carry moisture from the grain into the atmosphere. A vertically adjustable grain inlet tube skirt is positioned above, concentric with, and relatively closely spaced from the pervious top cone in position to receive and encompass grain delivered to be dried and to direct it to the top of the cone thus to form a conical layer of grain on the cone when a full grain column is established, the thickness of the conical grain layer being a function of the height of the skirt above the pervious top cone.

An upright impervious outer wall is supported in outwardly spaced concentric relation to the upright outer pervious wall to define, with at least part of that outer pervious wall, a recycle chamber for heated air, the upright impervious wall being partially defined by a ring-like top end effectively no higher than the height of the top end of the inner upright pervious wall and by a ring-like bottom end terminating at an intermediate location vertically positioned between the outer edge of the bulkhead baffle and the upper surface of the base.

An impervious hottest air recycle collar extends from its top end in initial contact with a ring-like portion of the outer pervious wall at an intermediate location vertically positioned between the top end of the inner pervious wall and the outer edge of the bulkhead baffle to its bottom end which is at a location vertically positioned below the outer edge of the bulkhead baffle and above the effective bottom end of the impervious outer wall. This collar, between its top and bottom ends, is in spaced relation to both the outer pervious wall and the impervious outer wall.

The plane of the top end of the inner pervious wall and the plane of the top end of the recycle collar define between them a first section of the grain column; the plane of the top end of the recycle collar and the plane of the ring-like connection of the outer edge of the bulkhead baffle to the inner pervious wall define between them a second grain column section; the plane of the ring-like connection of the outer end of the bulkhead baffle to the inner pervious wall and the plane of the bottom end of the recycle collar define between them a third grain column section; the plane of the bottom end of the recycle collar and the plane of the effective bottom end of the impervious outer wall define between them a fourth grain column section; and the plane of the effective bottom end of the impervious outer wall and the plane of the bottom of the upright outer pervious wall define between them a fifth grain column section.

Hot air leaving the top of the heater blower duct and passing through the pervious walls of the second grain column section will have access to the pervious walls of the third grain column section and will pass through those walls due to the pressure differential between the upper and lower plenums.

The heated air leaving through the top of the dryer and conditioner due to the action of the heater/blower assembly will result in unheated ambient air being drawn into the lower plenum through the pervious walls of the fifth grain column section to mix with the recycled partially heated, partially moisture-laden air passing into the lower plenum through the third and fourth grain column sections, that mixture then being drawn into the heater/blower assembly.

BRIEF DESCRIPTION OF THE DRAWINGS

FIG. 5 is an enlarged, fragmentary horizontal sectional view taken on the line 5—5 in FIG. 2;

FIG. 6 is an enlarged fragmentary, plan view of what could be part of a typical pervious wall or cone of the invention.

DETAILED DESCRIPTION OF THE PREFERRED EMBODIMENTS

Figure 1:
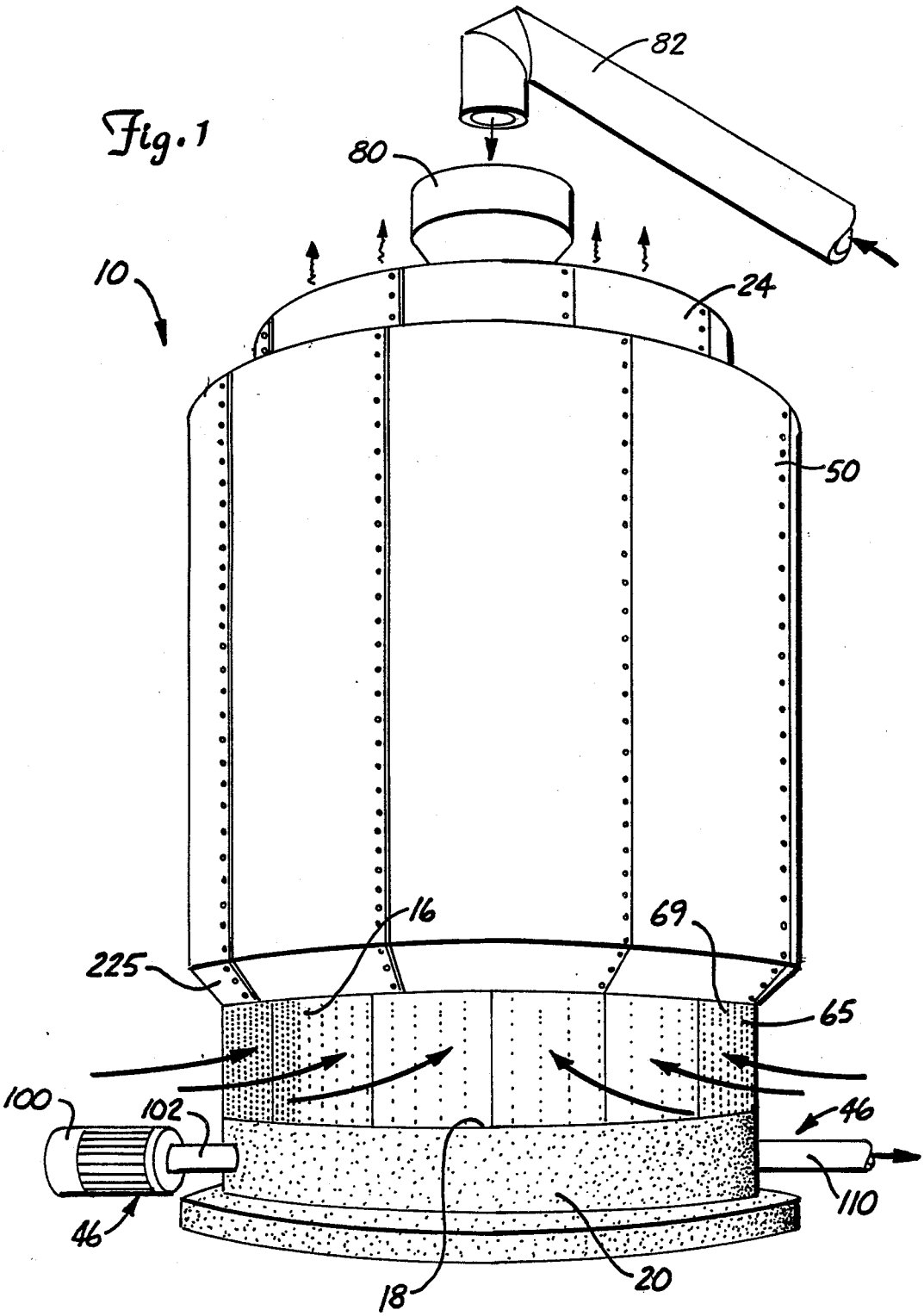
FIG. 1 is an elevational view of a grain dryer and conditioner of the present invention.

A grain dryer and conditioner 10 operates to dry grain 11 by forcing heated air to pass through the grain to heat the grain so as to drive moisture off from it. A vertical column of grain 12 is formed by a pair of cylindrical or ring-like, mutually concentric, upright, spaced-apart pervious walls; inner pervious wall 14 and outer pervious wall 16. These walls are supported on an upper horizontal surface 18 of a concrete base 20. A top cone 22 extends upwardly from the circular or ring-like top end of the inner pervious wall 14 in a position such that when grain to be dried is delivered to the top of the top cone 22, it will slide down the cone by gravity into the space between upright pervious walls 14 and 16 to form part of the grain column 12. A cylindrical grain sideboard 24 extends upwardly from the top circular or ring-like edge of the outer pervious wall 16 in position to prevent grain sliding down the cone 22 from getting beyond the outer pervious wall 16.

While cylindrical walls 14 and 16 are preferred, it is recognized that walls which are generally concentric but are square, rectangular, octagonal, or otherwise shaped in horizontal section would also provide many of the advantages to the invention. For that reason, many of the walls and other elements shown herein as circular or cylindrical are sometimes referred to as "ring-like" to include such other shapes within the scope of this specification and the claims which follow.

An upwardly blowing heater/blower assembly 30 includes an electrically driven blower motor 32, a gas fired heater 34, and a cylindrical impervious heater/-blower outer duct 36 inside of which the blower and heater are fixedly positioned. This heater/blower assembly 30 and its duct 36 are fixedly positioned in concentric relationship with respect to the upright pervious walls 14 and 16 by bulkhead means 38. As shown herein, this bulkhead means 36 is attached in a circular or ring-like fashion from about 2/5 of the way down the inner pervious wall 14 to about the middle of the outer surface of the heater/blower duct 36. Also as shown herein, this bulkhead means includes a bulkhead baffle 40 extending from a circular or ring-like portion of the heater/blower assembly duct 36 upwardly in a conical fashion to connect to the aforementioned circular or ring-like portion of the upright inner pervious wall 14.

This inner pervious wall 14 terminates in spaced relation to the upper surface 18 of the base 20, while the lower edge of the outer pervious wall 16 terminates against this base surface. This permits grain 11 in the grain column between these walls to discharge inwardly under the bottom of the inner pervious wall 14 until such time as the natural angle of repose of the flowing grain on surface 18 blocks further movement of the grain from the grain column.

Dried grain handling means 46 is provided to receive this dried and conditioned grain discharging from the bottom of the grain column and to deliver it to a place for storage and use.

All of the various elements of the structures described above have been utilized in grain dryers previously What follows is, then, a description of the improvements of the present invention over the apparatus and methods of the prior art.

The top cone 22 is pervious to allow heated air to pass through a fresh layer of untreated grain delivered to the top of the cone 22 to begin the heating of the grain and to carry moisture from the grain into the atmosphere. It is the presence of the cylindrical grain sideboard 24 which makes it possible for this layer of grain-to-be-dried to build up on the top of the cone 22.

An upright, heat insulated, cylindrical, impervious outer wall 50 is supported in outwardly spaced, concentric relation to the upright outer pervous wall 16 to define, with at least part of wall 16, an insulated recycle chamber 52. The impervious outer wall 50 is partially defined by a circular or ring-like top end at about the same height as the top end of the inner upright pervious wall 14 and by a circular or ring-like bottom end effectively terminating at about one-third of the distance up from the upper surface 18 of the base 20 toward the circular or ring-like position where the bulkhead baffle is attached to the upright inner pervious wall 14.

An impervious discoid end cap 51 forms an impervious recycle chamber top end cap means to seal off the space between the top end of the impervious outer wall 50 and the effective top end of the outer pervious wall 16.

An impervious hottest air recycle collar 54 extends from a position in initial contact with a circular or ring-like portion of the outer pervious wall 16 at an intermediate position about halfway between the top of the inner pervious wall 14 and the connection of the bulkhead baffle 40 to that inner pervious wall.

As used herein, a wall or other structure is "pervious" when it is permeable to air and other gases and to certain very fine solid particles while being impenetrable by the kernels of grain being processed. A wall or other structure is "impervious" when it is impenetrable by gas, liquids or solids of any kind encountered in the use of the grain dryer.

In order to properly dry grain, the grain must be taken from its relatively wet state at ambient temperature and moved through the dryer bringing it up to the maximum temperature necessary to achieve drying and then cooling it down gradually until it is properly conditioned to leave the dryer after the desired amount of moisture has been removed. Severe and rapid increases in temperature, decreases in moisture content, and, equally, severe and rapid decreases in temperature can cause internal tensions in the individual grain kernels. For example, grain kernels can crack open in a manner somewhat analogous to puffed rice or popcorn, greatly reducing the value of the grain. In grain dryers made according to the invention, by moving heated air and cooling air through various portions or sections of the grain dryer, the grain is dried and at the same time conditioned by being gradually brought to a maximum temperature and then gradually cooled as it moves down the top cone, into and through the grain column and is finally discharged at the bottom of the dryer. At the point of discharge, it is fully conditioned by having achieved the required dryness and desired temperature while, at the same time, eliminating any imposition of deleterious internal stresses to the kernels due to sudden or extremes changes in heat and moisture content.

In addition to the flow of heated air and moisture outwardly through the layer of grain lying on the top of the pervious top cone 22, the air flow is controlled through five separate portions or sections of the grain column 12.

The top end of the inner pervious wall 14 and the circular or ring-like initial connection of the hottest air recycle collar 54 to the outer pervious wall 16 above the bulkhead baffle 40 partially define top and bottom horizontal planes, respectively, of a first section 61 of the grain column 12.

The circular or ring-like initial connection of the recycle collar 54 to the outer pervious wall 16 and the circular or ring-like connection of the bulkhead baffle 40 to the inner pervious wall 14 partially define top and bottom planes, respectively, of a second grain column section 62. The circular, ring-like connection of the bulkhead baffle 40 to the inner pervious wall 14 and the circular, ring-like lowermost end of the recycle collar 54 partially define top and bottom planes, respectively, of a third grain column section 63.

The ring-like lowermost end of the recycle collar 54 and the effective lowermost end of the impervious outer wall 50 partially define the top and bottom planes, respectively, of a fourth grain column section 64.

The effective lowermost end of the impervious outer wall 50 and the bottom of the upright outer pervious wall 16 together define the top and bottom planes of a fifth grain column section 65.

With the blower motor 32 driving the heater/blower assembly 30 to discharge air upwardly, with the gas fired heater 34 in operation, and with a layer of newly delivered wettest grain 11 at ambient temperature forming a conical layer on top of the pervious cone 22, the direct blast of heated air from the heater/blower assembly 30 passes through the pervious cone 22 to begin heating the kernels supported on the cone and to carry some of the initial moisture from those kernels into the atmosphere.

The recycle collar 54 is referred to herein as the "hottest air recycle collar 54" because tests have shown that, when the grain dryer is in operation, the hottest air leaving the top of the heater/blower assembly 30 is the air closest to the upper outlet of the heater/blower duct 36, and that the hottest air passing outwardly through the grain column 12 is that air passing out immediately above the bulkhead baffle 40. Therefore, the positioning of the impervious hottest air recycle collar 54 is such as to insure that this hottest air leaving the top of the heater/blower duct 36 and passing out through the pervious walls 14 and 16 of the second grain column section 62 will have exclusive access to the pervious walls 16 and 14 of the third grain column section 63 and will pass through those walls due to the pressure differential between an upper heated plenum 66 inside inner pervious wall 14 and above the bulkhead baffle 40 and a lower cooling and mixing plenum 67 inside wall 14 and below baffle 40.

The positioning of the insulated impervious outer wall 50, the positioning of the recycle collar 54, and the space between the impervious outer wall 50 and the impervious recycle collar 54 are such as to insure that heated air leaving the upper heated plenum 66 through the pervious walls 14 and 16 of the first grain column section 61 will pass into the insulated recycle chamber 52, striking the insulated, impervious outer wall 50 and then passing through that insulated recycle chamber between the impervious outer wall 50 and the impervious recycle collar 54 to reach and pass through the pervious walls 16 and 14 of the fourth grain column section 64 due to the pressure differential between the upper plenum 66 and lower plenum 67 induced by the action of the heater/blower assembly 30.

The heated air leaving the grain dryer and conditioner 10 through the pervious top cone 22 due to the action of the heater/blower assembly 30 will result in unheated air at ambient temperature and ambient moisture content being drawn into the lower plenum 67 through the pervious walls 16 and 14 of the fifth grain column section 65, there to mix with the recycled air and moisture passing into the lower plenum 67 through the third grain column section 63 and the fourth grain column section 64.

Grain dryers made according to the present invention can be made to handle many kinds of grain such, for example, as corn, barley, milo, rice, oats, soybeans, sunflower seeds, and even wheat. The makeup of the pervious walls and the pervious top cone will, ideally, be varied to accommodate the size and nature of the grain being dried and conditioned; but, in certain instances, these makeups can be compromised so that one grain dryer can sometimes handle more than one kind of grain.

For the drying and conditioning of corn or maze, the inner and outer pervious walls 14 and 16 and the pervious top cone 22 will be effective when made of No. 16 gauge sheet metal with holes or perforations 69 five thirtyseconds of an inch in diameter and with sufficient staggered holes so that thirty percent of the surface is open to the flow of air therethrough. Such specifications have also been found to be effective in drying and conditioning soybeans.

Figure 4:
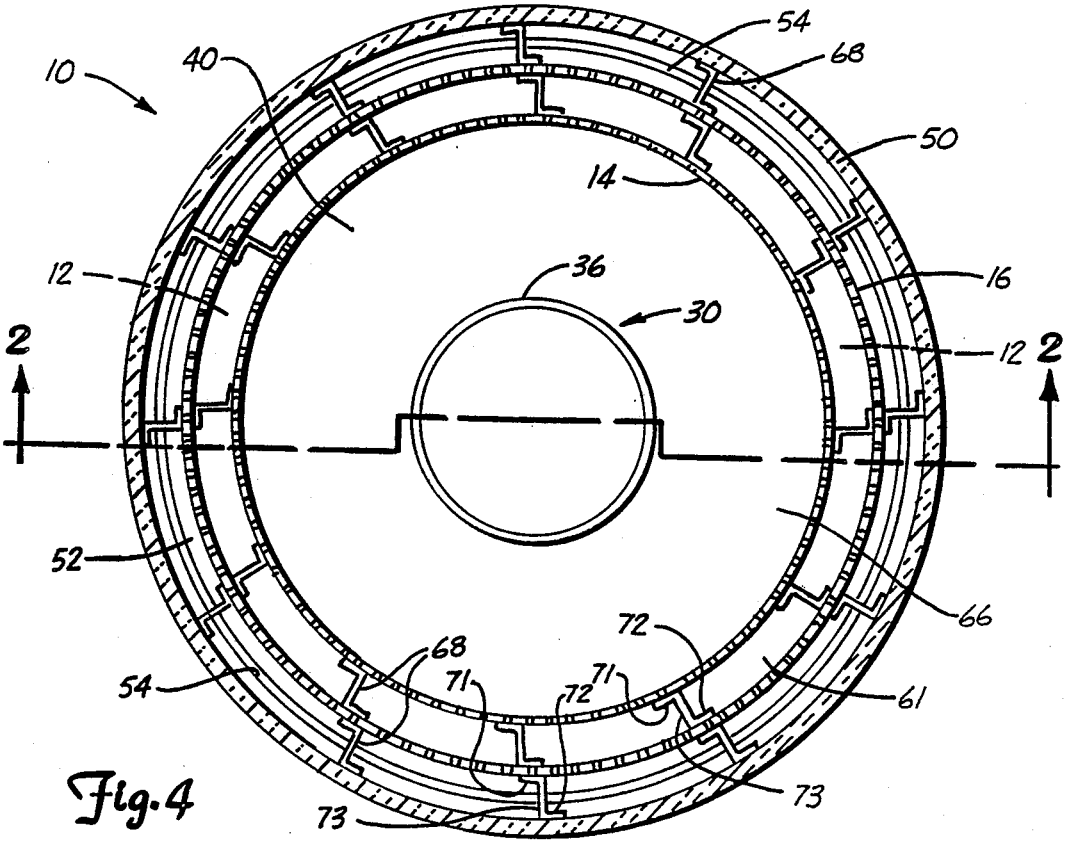
FIG. 4 is a horizontal sectional view taken on the line 4—4 in FIG. 2 with the grain in the grain column omitted.

In order to properly support the dryer 10 and its various parts, a plurality of elongated vertical Z-bars 68 are used. A first set of Z-bars 68 are used to support five sections of the inner pervious wall 14 and five sections of the outer pervious wall 16 in concentric relationship with respect to each other. In this first set of Z-bars, there are twelve such spaced-apart Z-bars 68 connecting each section of the pervious walls 14 and 16 to each other. Each Z-bar 68 has an inner leg 71, an outer leg 72 parallel to the inner leg and a flat webb 73 integral with both of the legs and at right angles to each. The outer leg 72 of each of the first set of Z-bars 68 is fastened against an interior surface of its outer pervious wall section 16 by welding, riveting, bolting or any other preferred means. Similarly, the inner leg 71 of each such Z-bar is attached to the outer surface of its inner pervious wall section 14. See FIG. 4.

Each of the five grain bin sections, in the form of the invention as shown, can be approximately four feet high, and the sections can be assembled one at a time on the base 20, the first grain bin section, the top cone 22, and other top superstructure (which will be later described in more detail) can be assembled together on the concrete base 20 and then jacked up high enough so that the second grain bin section can be assembled beneath the first section, bolted to it, and then both sections and the top superstructure can be jacked up to add, in sequence, the third, fourth, and fifth grain bin sections. The first set of Z-bars 68 of each section are fastened to their aligned upper and lower counterparts to constitute a unitary structure by the use of Z-bar tie plates 74. Each such plate 74 is bolted or riveted to the Z-bar web 73 of an upper section and to the vertically aligned Z-bar web 73 of the next lower section as seen in FIGS. 2 and 5.

Figure 2:
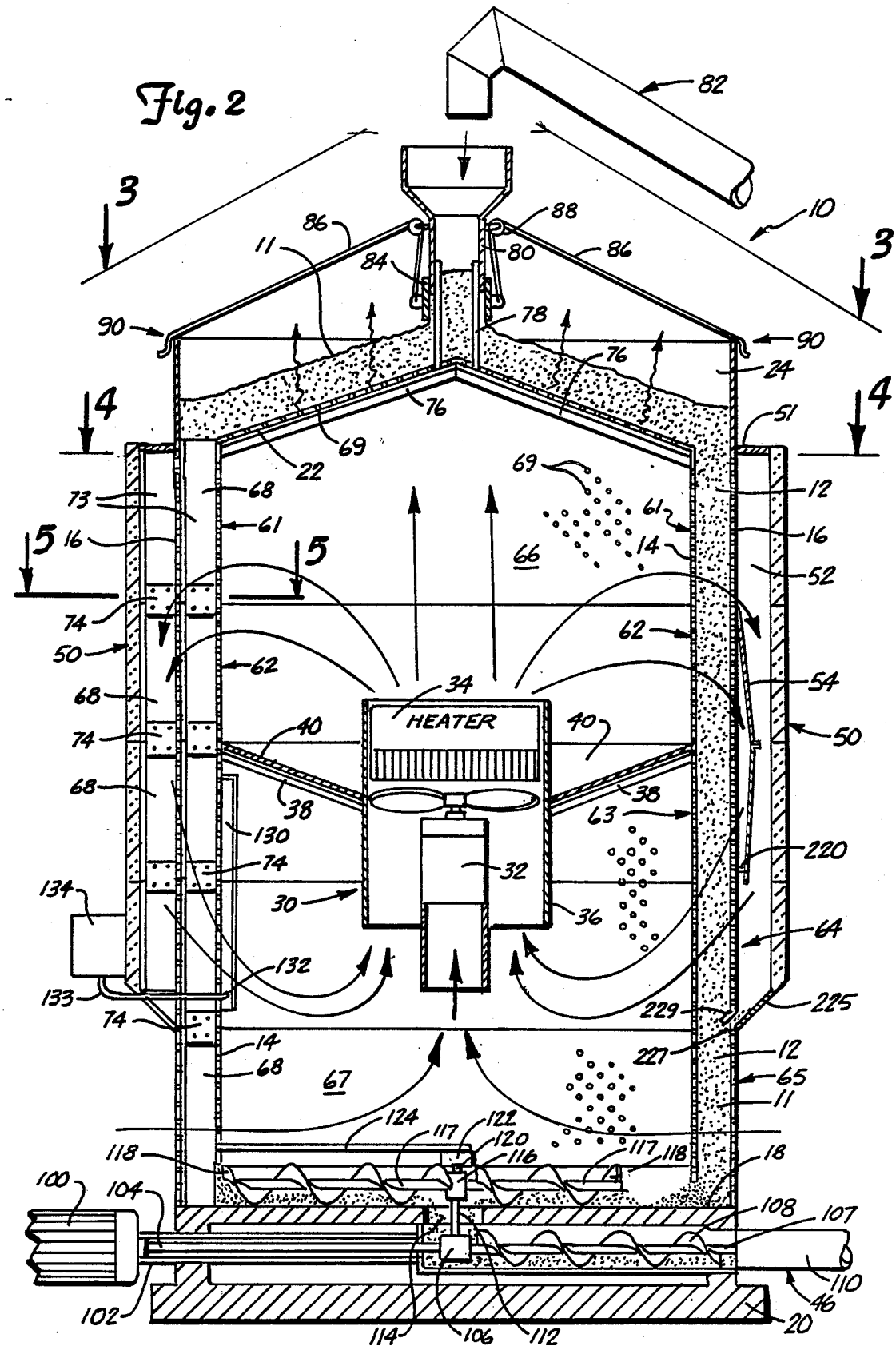
FIG. 2 is a vertical transverse sectional view of the dryer of FIG. 1 taken on the line 2—2 in FIG. 4.

For clarity of illustration, the hottest air recycle collar 54 and the representation of the grain 11 in grain column 12 have been omitted from FIG. 5 and the left side of FIG. 2.

Many different materials can be successfully used to constitute the impervious outer wall 50; but a structure which has been found to be satisfactory consists of four foot high cylindrical rings of laminates, each ring being made up of a plurality of four foot by four foot panels 200 having circumferentially overlapping end portions. Each such panel can include an outside fiberglass sheet 201 1/8" thick, next a three-quarter inch thick layer of expanded urethane foam 202, followed by an inside sheet 204 of 1/8"fiberglass, and an innermost aluminum foil liner 206 to reflect the heat from the heated air back into the dryer.

A second set of Z-bars 68 are used to support these four sections of laminated rings which make up the upright, heat insulated, impervious outer wall 50. Each of the Z-bars 68 of the second set is supported by one of the Z-bars 68 of the first set associated with grain column sections one through four. As set out above, the outer leg 72 of each of the first set of Z-bars 68 is attached to and supports part of the outer pervious wall 16. The inner leg 71 of each of the second set of Z-bars 68 aligned with grain column sections one through four are fastened as at 75 through the pervious outer wall 16 and into the outer leg 72 of one of the Z-bars of the first set.

Fasteners, such as rivets 2O8, for example, can extend through overlapped circumferential edges of the four foot by four foot laminate panels 200 and through the outer legs 72 of the second set of Z-bars 68.

The thickness of the grain column 12 is dictated by the design of the grain dryer. In dryers of the prior art, a grain column thickness approaching two feet or even more has been found necessary. This necessitates a blower of capacity sufficient to force a substantial volume of air through such a relatively thick grain column. In contrast, the dryer of the present invention can operate successfully with a much thinner grain column. A thickness of only 9"between inner wall 14 and outer wall 16 has been found satisfactory. A spacing of 9"between the outer pervious wall 16 and the impervious outer wall 50 has also been found to be satisfactory. In the form of the invention as shown, these two dimensions are established by the width between the outer legs 72 and the inner legs 71 of the Z-bar webs 73 of the first and second sets of Z-bars 68.

Figure 3:
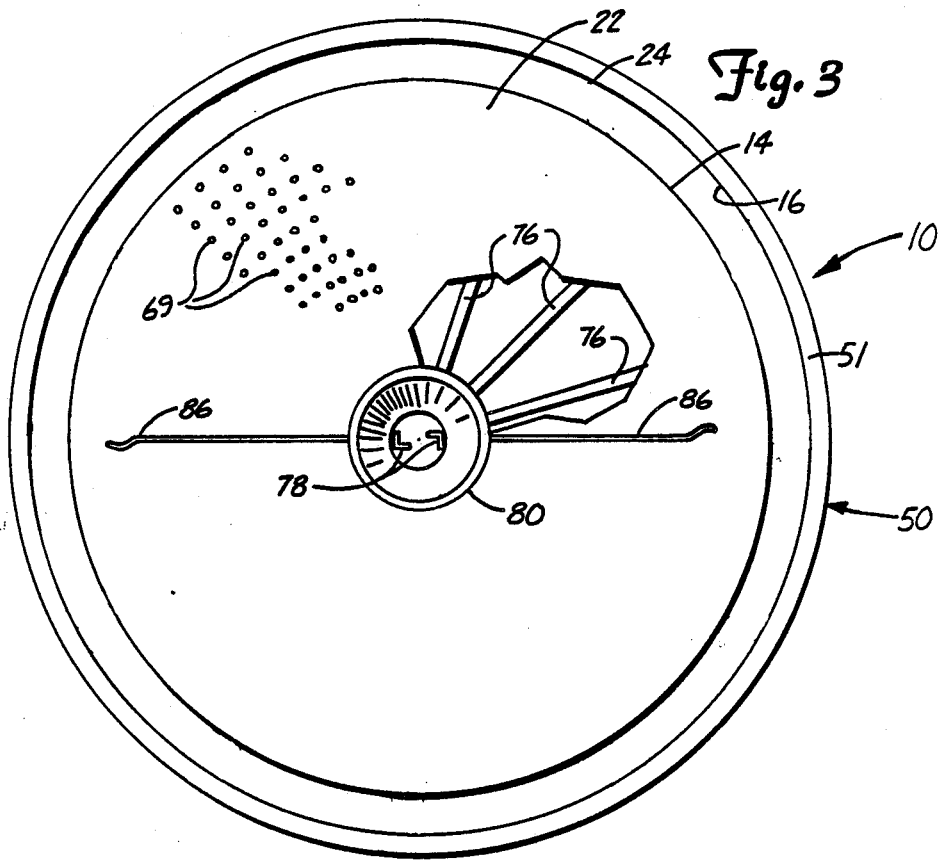
FIG. 3 is a top plan view of the dryer of FIGS. 1 and 2, taken on the line 3—3 in FIG. 2 with the grain to be dried omitted for clarity of illustration.

As perhaps best seen in FIGS. 2 and 3, a series of upwardly and radially extending angle irons 76 are bolted or welded to the inner legs 71 of the first set of Z-bars 68 of the first grain bin section and extend upwardly to support the pervious cone 22. In the form of the invention as shown, these angle irons 76 and the cone 22 lie at an angle of 20° from the horizontal. This angle has been found to retard the flow of a grain such as corn down the cone 22 sufficiently to eliminate the buildup of "bees wings", chaff and other fines against the grain sideboard, which was a problem prevalent in prior art dryers of this general type. For processing corn, for example, a cone angle of 25° has been found to be excessive so that such fines are not eliminated. The operation of the dryer so as to incorporate such fines into the grain column is later discussed herein.

When kernels of grain or other discrete particles are allowed to flow onto a supporting surface, the upper surface of the grain or the like will tend to come to rest at an angle of repose with respect to the horizontal depending on many factors such as the size of the particles, the character of the surface of the particles, the coefficient of friction between particles, the moisture content of the particles, etc. In order to maintain a relatively even thickness of grain to be dried over the entire pervious top cone 22, the angle of the cone with respect to horizontal should be the same as Or should approximate the average anticipated angle of repose of the grain to be dried in the dryer. As shown in this specification, 20° for corn. Constructing the cone 22 at or near the repose angle has the further advantage of retarding the rate of flow of grain down the cone 22 to compensate for grain being removed from two spaced-apart points around the bottom of the grain column. The importance of this feature will be evident later in this specification.

Rigidly attached to inner ends of at least two of the cone support angle irons 76 are vertical angle irons 78 supporting from the inside a vertical, cylindrical grain inlet tube and funnel 80. In the form of the invention as shown, a grain feed tube 82 of any usual or preferred construction is situated to discharge relatively moist grain for drying and conditioning into the funnel and inlet tube 80 from a source not shown.

From an understanding of the foregoing, it will be evident that all of the moisture which leaves the grain dryer and conditioner 10 passes out through the pervious top cone 22 and the grain positioned on that cone. Therefore, one of the means of controlling the amount of drying which takes place is to control the depth of the layer of moist grain on top of the cone 22.

This is accomplished by the use of a vertically adjustable grain height skirt 84. As best seen in FIG. 2, this cylindrical skirt 84 is vertically slidable along the outside of feed tube 80 and can be supported at any desired height by a pair of skirt control ropes 86 running through pulleys or blocks 88, for example. As shown, ropes 86 can be cleated as at 90 at any convenient location below the top of the grain sideboard 24. While shown to be entirely manual in operation, it is to be understood that this adjustable skirt 84 could be motor controlled by an operator or even by a transducer responding to the temperature and/or moisture in the grain 11 exiting the dryer.

In operation, grain will flow to a height over the cone 22 as determined by the positioning of the bottom edge of the skirt 84 and the angle of repose of the grain.

Where additional drying is needed to achieve the desired moisture content in the grain leaving the dryer, the skirt 84 will be raised thus increasing the thickness of the grain layer on the top cone 22 and consequently increasing the resistance to air flow. This causes an increase in static pressure in the upper plenum 66. This change in pressure can be used to regulate gas flow to achieve maximum efficiency in operation.

As stated above, the only moisture leaving the dryer is leaving out through the pervious top cone 22 and through the grain resting on top of it. The heated air recycling out through the first and second sections of the grain column, and back in through the third and fourth sections will, of course, carry some moisture. However, it has been found that this recycled heated air is, at that point, not carrying all of the moisture which its temperature will allow it to carry, so it is still picking up moisture during passes in both directions, out and in. Upon arrival in the lower cooling and mixing plenum 67, this heated, somewhat moist air is mixed with the cooler, drier air entering through the sixth grain column section, and it is this mixture which is drawn through the heater/blower assembly 30.

The outward flow through the top cone tends to fluidize or float the grain on top of the cone because there is no restriction to the movement of this grain being blasted with hot air from the heater/blower assembly 30 except the influence of gravity. This fluidizing action greatly enhances the movement of the kernels with respect to each other and very greatly enhances the ability of the heated air to extract any external moisture from these relatively moving fluidized particles or kernels.

As shown, the dried grain handling means 46 includes a two-speed back geared motor assembly 100 supported on an eight inch diameter motor assembly and gear box support tube 102 which extends rigidly outwardly from the concrete base 20 of the dryer to the left as seen in FIGS. 1 and 2. Inside of this support tube 102, a drive shaft 104 extends from the motor assembly 100 into a first gear box 106. A first output shaft 107 from the first gear box 106 extends in direction away from and is concentric with the drive shaft 104 and drives a dried grain discharge auger 108 running in a grain discharge conduit 110 which is provided in the concrete base 20.

A vertical second output shaft 112 from the first gear box 106 extends vertically upwardly of said first gear box through the middle of a discharge conduit access port 114 provided in base 20 and into a second gear box 116. This second gear box has three output shafts, the first two of which (117,117) are horizontal and extend at right angles to the vertical shaft 112. These shafts 117,117 rotate gathering augers 118,118 in opposite directions so that grain discharging in a circular ring out from under the inner pervious wall 14 at the bottom of the grain column 12 will be gathered and carried away from grain column 12 toward and into the discharge conduit access port 114. A vertical third output shaft 120 from the second gear box 116 goes into a third gear box 122 where it drives a gear (not shown) which meshes with a gear inside gear box 122 which is held stationary by a torque arm 124 fixedly and rigidly extending outwardly from the inner pervious wall 14. The action or reaction of the third output shaft 120 and its rotating gear causes the second gear box 116 and consequently the gathering augers 118,118 to revolve around the upper surface 18 of the base 20 to continuously move the grain flowing outwardly from under the inner pervious wall 14 at points which are 180° apart.

The motor of the back geared motor assembly 100, in one form of the invention, can be operated at either 600 or 18OO RPM. Therefore, when less heat energy is needed to dry grain not having excessive moisture, the higher speed of the motor can be used. Where more heat energy is needed to dry grain with greater initial moisture content, the motor assembly 100 and the other grain handling means 46 can be operated at one third that the speed.

Many sophisticated arrangements have been designed to monitor the average moisture content of the grain being discharged, so that adjustments can be made to insure that the grain, when finally leaving the dryer, will have the moisture content within the desired specified parameters. It has been found by the present inventor, however, that an average of the grain temperature existing in the third and fourth grain column sections 63 and 64 is a reliable indication of the moisture content in that grain when it is discharged from the dryer of the present invention. To determine this average temperature by an efficient means, a channel iron 130 is affixed vertically to the inner surface of the wall 14 adjacent the third and fourth grain column sections. The top end of this channel iron is closed against the wall 14, a temperature responsive transducer means such as a thermocouple 132 is situated at the bottom of the channel iron 130 with conduit means such as electrical leads 133 running to a control box 134 where they can be attached to mechanism providing a readout of temperature, and/or an equivalent moisture content readout.

By adjusting the position of the lower edge of the adjustable skirt 84, the gas flow to the heater, and/or the speed of the back geared motor assembly 100, the operator can readily operate the dryer to deliver the grain at the desired moisture content either manually or automatically through various control circuits forming no part of the present invention.

Figure 7:
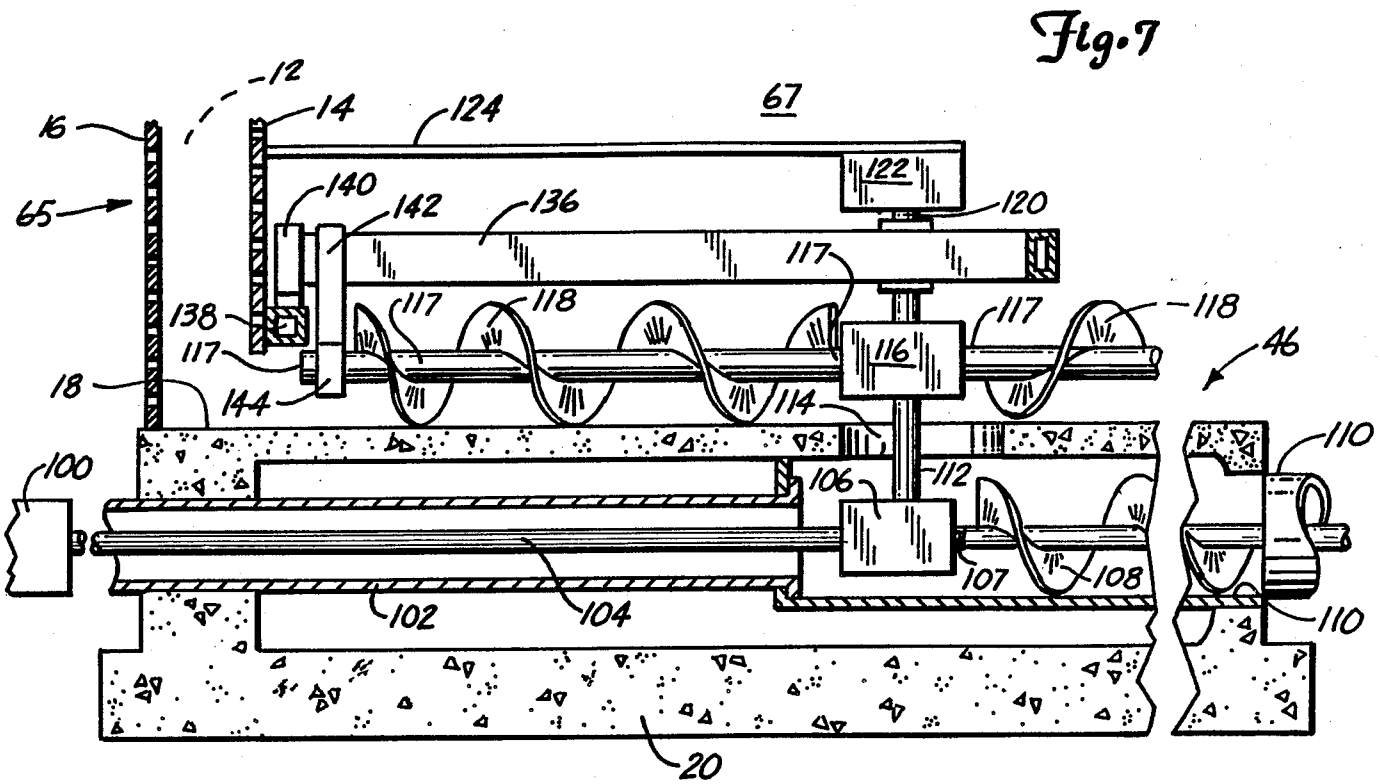
FIG. 7 is an enlarged fragmentary, vertical sectional view of the grain dryer as seen in a lower portion of FIG. 2 and showing details of handling means for dried and conditioned grain.

Referring now to FIG. 7, the dried grain handling means 46 includes a hollow, square, tubular, gathering auger support bar 136 mounted at a central point to encompass the vertical third output shaft 120 from the second gear box 116. Outer ends of the auger support bar 136 are supported on a toroidal or ring-shape, hollow, tubular, support flange 138 which, as shown, is generally square in transverse cross section. This flange 138 is mounted at the bottom of the cylindrical, upright inner pervious wall 14 and supported through that wall on the inner legs 71 of the first set of Z-bars 68 of the fifth grain bin section to extend inwardly from wall 14. Outermost end portions 140 of the support bar 136 and the upper surface of the support flange 138 are each coated with long-wearing, weight-bearing material, each of which has a relatively low coeffient of friction with respect to the other. Depending from each of the outer end portions of the support bar 136 are bearing support straps 142 holding bearings 144 on which outer ends of the auger shafts or horizontal second output shafts 117,117 are journalled.

A certain amount of foreign materials inevitably accompany grains to be dried and conditioned. Some can be of generally the same size the individual kernels of grain and these materials will pass through the dryer with the grain without difficulty. Smaller particles or "fines" are made up of, among other things, insect parts (sometimes referred to generally as "bees wings"), dust and fragments from the kernels themselves and from the stalks, cobs, etc. from which they came. Much of such fines are flammable and can be troublesome.

In previous grain column dryers fed from above onto impervious cones, such fines came to the top as the grain moved down the cone and stayed there against the grain side board forming a rolling, endless, toroidal ring of such flammable foreign matter. One way to eliminate this material is to have it fall with the grain into the grain column. This is accomplished, according to this invention, by the method and speed of moving the grain away from the bottom of the column as it falls from under the bottom of the inner pervious wall 14. As the gathering augers 118,118 rotate and revolve around the upper surface 18 of base 20, their outermost end portions are constantly in contact with the grain extending from the bottom of wall 14 and lying at its natural angle of repose. In FIG. 2, the outer end portion of the right gathering auger 118 is broken away to show this normally extending grain 11 which, of course, will block further flow from grain column 12 until moved away by augers 118 and 118.

As the augers sweep the grain away from points at opposite sides of the grain column 12, the grain in vertical alignment with each auger moves abruptly down to replace the grain swept by the auger as it moves by. The vertical movement of the grain in column 12 is faster than the movement of replacement grain down the pervious cone 22; so as the augers sweep grain from the bottom of the column, at two rapidly moving points around the surface 18, two waterfall-like flows of grain off of the cone above follow this movement of the augers. The deleterious fines at the outer edge of the cone, adjacent the grain side board 24, fall with the grain "waterfall" and are incorporated harmlessly into the grain column 12.

It is also inevitable that the passage of heated air through various sections of the grain column as the grain dries will cause some fines originally in the grain and some minute particles separating from the drying kernels to pass through the openings in the upright pervious walls 14 and 16.

Fines passing inwardly through the third, fourth and fifth sections of inner pervious wall 14 are either carried by the air flow into the heater/blower assembly 30 where they are harmlessly burned up to add to the heat energy output, or fall through the air flow to the upper surface 18 of the base 20 where the augers 118 incorporate them into the dried and conditioned grain leaving the dryer.

Means is provided to reintroduce into the grain column those fines passing outwardly through the first and second sections of the outer pervious wall. Such means include a series of spacers 220 holding the bottom edge of the impervious hottest air recycle collar 54 in very slightly spaced relation to its point of attachment to the outer pervious wall 16. Fines passing out through the second section of wall 16 fall past the spacers 220.

Fines passing through the first and second sections of wall 16 fall to the bottom ring-like edge of the impervious outer wall 50. As shown, an impervious skirt 225 between the bottom of wall 50 and the outside of wall 16 directs these fines to the wall 16. At this level, an opening 227 is provided in wall 16 at least at intervals around the entire dryer 10 and a venturi-like flange 229 extends inwardly from wall 16 just above opening 227 to permit and cause such fines to reenter the grain column.

Although the present invention has been described with reference to preferred embodiments, workers skilled in the art will recognize that changes may be made in form and detail without departing from the spirit and scope of the invention.

For example, the grain column sections are herein shown and described as being of the same vertical dimension, i.e., four feet high. For a particular grain dryer, these and other dimensions may be altered without departing from the spirit of the invention and the scope of the claims which follow.

What is claimed is:

1. In a grain dryer and conditioner:

(1) including a base partially defined by a horizontal upper surface, (2) wherein a column of grain to be dried and conditioned is at least partially confined by a pair of ring-like, congruent, concen- tric, upright, spaced-apart, inner and outer pervious walls supported on and above the upper horizontal surface of the base, the inner wall effectively terminating at a ring-like, generally horizontal upper end surface, (3) wherein a top cone is positioned above the upright inner pervious wall to direct grain deposited on it to flow by gravity to the space between the upright pervious walls, (4) wherein means is provided to deliver grain to be dried and conditioned to fall on the top of the top cone, (5) wherein a grain side board extends upwardly from the outer pervious wall in position to support grain above the grain column so that grain falling from the top cone cannot get beyond the outer pervious wall, (6) wherein an upwardly blowing heater/blower assembly includes an impervious outer duct which is supported by bulkhead means at an intermediate position between the top and bottom of the upright pervious walls to be within and concentric with those walls, (7) wherein said bulkhead means includes a bulkhead baffle extending between a ring-like portion of the heater/blower assembly duct and a ring-like portion of the inner upright pervious wall in position to tend to block the return flow of heated air from the top of the heater/blower assembly duct back to the bottom of the duct inside of the inner pervious wall, the presence of bulkhead baffle thereby creating within the inner upright pervious wall a positively pressured upper heated plenum above the bulkhead baffle and a relatively negatively pressured lower plenum below the bulkhead baffle, and (8) wherein means is provided to receive grain discharging from between the pervious walls at the bottom of the grain column and to deliver it to a place of storage and use;

the improvement wherein:

(a) the top cone is pervious to allow heated air to pass through a grain layer on top of the cone to begin the heating of the grain and to carry moisture from the grain into the atmosphere;

(b) a vertically adjustable grain inlet tube skirt is positioned above, concentric with, and relatively closely spaced from the pervious top cone in position to receive and encompass grain delivered to be dried and conditioned and to direct it to the top of the cone to form a conical layer of grain on the cone when a full grain column is established, the thickness of the conical grain layer being a function of the height of the skirt above the pervious top cone;

(c) an upright impervious outer wall is supported in outwardly spaced concentric relation to said upright outer pervious wall to define, with at least part of that outer pervious wall, a recycle chamber for heated air, the upright impervious wall being partially defined by a ring-like top end effectively no higher than the height of the top end of the inner upright pervious wall and by a ring-like bottom end terminating at an intermediate location vertically positioned between the outer edge of the bulkhead baffle and the upper surface of the base;

(d) an impervious hottest air recycle collar extends from its top end in initial contact with a ring-like portion of the outer pervious wall at an intermediate location vertically positioned between the top end of the inner pervious wall and the outer edge of the bulkhead baffle to its bottom end which is at a location vertically positioned below the outer edge of the bulkhead baffle and above the effective bottom end of the impervious outer wall, said collar, between its top and bottom ends, being in spaced relation to both the outer pervious wall and the impervious outer wall;

(e) the plane of the top end of the inner pervious wall and the plane of the top end of the recycle collar define between them a first section of the grain column;

(f) the plane of the top end of the recycle collar and the plane of the ring-like connection of the outer edge of the bulkhead baffle to the inner pervious wall define between them a second grain column section;

(g) the plane of the ring-like connection of the outer edge of the bulkhead baffle to the inner pervious wall and the plane of the bottom end of the recycle collar define between a third grain column section;

(h) the plane of the bottom end of the recycle collar and the plane of the effective bottom end of the impervious outer wall define between them a fourth grain column section;

(i) the plane of the effective bottom end of the impervious outer wall and the plane of the bottom of the upright outer pervious wall define between them a fifth grain column section;

(j) the positioning of the recycle collar is such as to insure that the hot air leaving the top of the heater/blower duct and passing through the pervious walls of the second grain column section will have access to the pervious walls of the third grain column section and will pass through those walls due to the pressure differential between the upper and lower plenums; and (k) the heated air leaving through the top of the dryer and conditioner due to the action of the heater/blower assembly will result in unheated ambient air being drawn into the lower plenum through the pervious walls of the fifth grain column section to mix with the recycled partially moisture laden air passing into the lower plenum through the third and fourth grain column sections, that mixture then being drawn into the heater/blower assembly.

2. The grain dryer and conditioner of claim 1 wherein:

(1) the angle of the impervious cone to the horizontal is approximately the same as the angle of repose of the grain to be dried.

3. The grain dryer and conditioner of claim 2 wherein:

(m) the angle of the cone with respect to the horizontal is approximately 20°.

4. The grain dryer and conditioner of claim 1 wherein:

(1) the upright impervious outer wall is heat insulated.

5. In a grain dryer and conditioner:

(1) including a base partially defined by a horizontal upper surface, (2) wherein a column of grain to be dried and conditioned is at least partially confined by a pair of ring-like, congruent, concen- tric, upright, spaced-apart, inner and outer pervious walls supported on and above the upper horizontal surface of the base, the inner wall effectively terminating at a ring-like, generally horizontal upper end surface, (3) wherein a top cone is positioned above the upright inner pervious wall to direct grain deposited on it to flow by gravity to the space between the upright pervious walls, (4) wherein means is provided to deliver grain to be dried and conditioned to fall on the top of the top cone, (5) wherein a grain side board extends upwardly from the outer pervious wall in position to support grain above the grain column so that grain falling from the top cone cannot get beyond the outer pervious wall, (6) wherein an upwardly blowing heater/blower assembly includes an impervious outer duct which is supported by bulkhead means at an intermediate position between the top and bottom of the upright pervious walls to be within and concentric with those walls, (7)wherein said bulkhead means includes a bulkhead baffle extending between a ring-like portion of the heater/blower assembly duct and a ring-like portion of the inner upright pervious wall in position to tend to block the return flow of heated air from the top of the heater/blower assembly duct back to the bottom of the duct inside of the inner pervious wall, the presence of bulkhead baffle thereby creating within the inner upright pervious wall a positively pressured upper heated plenum above the bulkhead baffle and a relatively negatively pressured lower mixing plenum below the bulkhead baffle, and (8)wherein means is provided to receive grain discharging from between the pervious walls at the bottom of the grain column and to deliver it to a place of storage and use;

the improvement wherein:

(a) the top cone is pervious to allow heated air to pass through a grain layer on top of the cone to begin the heating of the grain and to carry moisture from the grain into the atmosphere;

(b) a vertically adjustable grain inlet tube skirt is positioned above, concentric with, and relatively closely spaced from the pervious top cone in position to receive and encompass grain delivered to be dried and conditioned and to direct it to the top of the cone to form a conical layer of grain on the cone when a full grain column is established, the thickness of the conical grain layer being a function of the height of the skirt above the pervious top cone;

(c) an upright, heat insulated, impervious outer wall is supported in outwardly spaced, congruent, concentric relation to said upright outer pervious wall to define, with at least part of that outer pervious wall, an insulated recycle chamber for heated air, the upright impervious wall being partially defined by a ring- like top end effectively at substantially the same height as the top end of the inner upright pervious wall and by a ring-like bottom end terminating at an intermediate location vertically positioned between the outer edge of bulkhead baffle and the upper surface of the base;

(d) ring-like impervious recycle chamber end cap means seals the space between top end of the impervious outer wall and the effective top end of the outer pervious wall;

(e) an impervious hottest air recycle collar extends from its top end in initial contact with a ring-like portion of the outer pervious wall at an intermediate location vertically positioned between the top end of the inner pervious wall and the outer edge of the bulkhead baffle to its bottom ring-like end which is at a location vertically positioned below the outer edge of the bulkhead baffle and above the effective bottom end of the impervious outer wall, said collar, between its top and bottom ends, being in spaced relation to both the outer pervious wall and the impervious outer wall;

(f) the plane of the top end of the inner pervious wall and the plane of the bottom end of the recycle collar define between them a first section of the grain column;

(g) the plane of the top end of the recycle collar, and the plane of the ring-like connection of the outer edge of the bulkhead baffle to the inner pervious wall define between them a second grain colum section;

(h) the plane of the ring-like connection of the outer edge of the bulkhead baffle to the inner pervious wall and the plane of the bottom end of the recycle collar define between them a third grain column section;

(i) the plane of the bottom end of the recycle collar and the plane of the effective bottom end of the impervious outer wall define between them a fourth grain column section;

(j) the plane of the effective bottom end of the impervious outer wall and the plane of the bottom of the upright outer pervious wall define between them a fifth grain column section;

(k) the positioning of the recycle collar collar is such as to insure that the hot air leaving the top of the heater/blower duct and passing through the pervious walls of the second grain column section will have access to the pervious walls of the third grain column section and will pass through those walls due to the pressure differential between the upper and lower plenums;

(l) the positioning of the impervious outer outer wall, the positioning of the recycle collar, and the space between the impervious outer wall and the impervious recycle collar is such as to insure that heated air leaving the heated upper plenum through the pervious walls of first grain column section will pass to the impervious outer wall and then between that impervious outer wall and the impervious recycle collar to reach and pass through the pervious walls of the fourth grain column section due to the pressure differential between the upper and lower plenums created by the action of the heater/-blower assembly; and (m) the heated air leaving through the pervious top cone due to the action of the heater/blower assembly will result in unheated ambient air being drawn into the lower plenum through the pervious walls of the fifth grain column section to mix with the recycled partially moisture laden air passing into the lower plenum through the third and fourth grain column sections, that mixture then being drawn into the heater/blower assembly.

6. The grain dryer and conditioner of claim 5 wherein:

(n) the angle of the pervious top cone with respect to the horizontal is approximately the same as the angle of repose of the grain to be dried.

7. In a grain dryer and conditioner:

(1) including a base partially defined by a horizontal upper surface, (2) wherein a column of grain to be dried and conditioned is at least partially confined by a pair of ring-like, congruent, concen- tric, upright, spaced-apart, inner and outer pervious walls supported on and above the upper horizontal surface of the base, the inner wall effectively terminating at a ring-like, generally horizontal upper end surface, (3) wherein a top cone is positioned above the upright inner pervious wall to direct grain deposited on it to flow by gravity to the space between the upright pervious walls, (4) wherein means is provided to deliver grain to be dried and conditioned to fall on the top of the top cone, (5) wherein a grain side board extends upwardly from the outer pervious wall in position to support grain above the grain column so that grain falling from the top cone cannot get beyond the outer pervious wall, (6) wherein an upwardly blowing heater/blower assembly includes an impervious outer duct which is supported by bulkhead means at an intermediate position between the top and bottom of the upright pervious walls to be within and concentric with those walls, (7) wherein said bulkhead means includes a bulkhead baffle extending between a ring-like portion of the heater/blower assembly duct and a ring-like portion of the inner upright pervious wall in position to tend to block the return flow of heated air from the top of the heater/blower assembly duct back to the bottom of the duct inside of the inner pervious wall, the presence of bulkhead baffle thereby creating within the inner upright pervious wall a positively pressured upper heated plenum above the bulkhead baffle and a relatively negatively pressured lower mixing plenum below the bulkhead baffle, and (8)wherein means is provided to receive grain discharging from between the pervious walls at the bottom of the grain column and to deliver it to a place of storage and use;

the improvement wherein:

(a) an upright, impervious outer wall is supported in outwardly spaced concentric relation to said upright outer pervious wall to define, with at least part of that outer pervious wall, a recycle chamber for heated air, the upright impervious wall being partially defined by a ring-like top end effectively no higher than the height of the top end of the inner upright pervious wall and by a ring-like bottom end terminating at an intermediate location vertically positioned between the outer edge of the bulkhead baffle and the upper surface of the base;

(b) an impervious hottest air recycle collar extends from its top end in initial contact with a ring-like portion of the outer pervious wall at an intermediate location vertically positioned between the top end of the inner pervious wall and the outer edge of the bulkhead baffle to its ring-like bottom end which is at a location vertically positioned below the outer edge of the bulkhead baffle and above the effective bottom end of the impervious outer wall, said collar, between its top and bottom ends, being in spaced relation to both the outer pervious wall and the impervious outer wall;

(c) ring-like impervious recycle chamber end cap means seals the space between the impervious outer wall and the outer pervious wall at a location vertically positioned above the top end of the impervious hottest air recycle collar;

(d) the plane of the ring-like impervious recycle chamber end cap means and the plane of the top end of the recycle collar define between them a first section of the grain column;

(e) the plane of the top end of the recycle collar and the plane Of the ring-like connection of the outer edge of the bulkhead baffle to the inner pervious collar define between them a second grain column section;

(f) the plane of the ring-like connection of the outer edge of the bulkhead baffle to the inner pervious wall and the plane of the bottom end of the recycle collar define between them a third grain column section;

(g) the plane of the bottom end of the recycle collar and the plane of the effective bottom end of the impervious outer wall define between them a fourth grain column section;

(h) the plane of the effective bottom end of the impervious outer wall and the plane of the bottom of the upright outer pervious wall define between them a fifth grain column section;

(i) the positioning of the recycle collar is such as to insure that the hot air leaving the top of the heater/blower duct and passing through the pervious walls of the second grain column section will have access to the pervious walls of the third grain column section and will pass through those walls due to the pressure differential between the upper and lower plenums;

(j) the positioning of the impervious outer wall, the positioning of the impervious recycle chamber end cap means, the positioning of the recycle collar, and the space between the impervious outer wall and the impervious recycle collar is such as to insure that heated air leaving the heated upper plenum through the pervious walls of the first grain column section will pass to the impervious outer wall and then between the impervious outer wall and the impervious recycle collar reach and pass through the pervious walls of the fourth grain column section due to the pressure differential between the upper and lower plenums created by the action of the heater/blower assembly; and (k) the heated air leaving the top of the dryer and conditioner due to the action of the heater/blower assembly will result in unheated ambient air being drawn into the lower plenum through the previous walls of the fifth grain column section to mix with the recycled partially moisture- laden air passing into the lower plenum through the third and fourth grain column sections, that mixture then being drawn into the heater/blower assembly.

8. The grain dryer and conditioner of claim 7 wherein:

(1) the impervious outer wall is heated insulated.

9. The grain dryer and conditioner of claim 7 wherein:

(1) the inner pervious wall is supported on, but terminates in a ring-like bottom edge portion in spaced relation to, the upper horizontal surface of the base in such a manner that grain in the grain column will flow freely from the column under the bottom end of the inner pervious wall until the angle of the outwardly flowing grain intersects of the bottom of the inner pervious wall;

(m) the means provided to receive this grain discharging from the bottom of the grain column and to deliver it to a place for storage and use includes:

(i) a dried grain discharge conduit embedded in the base and extending radially outwardly from an inlet end concentric with the inner pervious wall to an outlet end extending outwardly from the base, (ii) a discharge conduit access port which is provided in the base and opens from the upper horizontal surface of the base vertically into the inner end of the grain discharge conduit, (iii) a motor assembly support tube embedded in the base and extending from an inner end open to the inner end of the grain discharge conduit to an outer end extending outwardly from the base, (iv) a motor assembly mounted to the outer end of the motor assembly support tube and including a motor assembly drive shaft extending in encompassed relation to the motor assembly support tube, (v) a first gear box operably connected to the motor assembly drive shaft and positioned in substantially vertical alignment with the discharge conduit access port and in horizontal alignment with the grain discharge conduit, provided with a horizontal first output shaft parallel to and encompassed by the grain discharge conduit and a vertical second output shaft extending vertically up into and through the discharge conduit access (vi) a dried grain discharge auger mounted in said grain discharge conduit in driven relationship with respect to the horizontal first output shaft, (vii) a second gear box above the upper surface of the base and receiving said second vertical output shaft, said second gear box being provided with horizontal third and fourth output shafts, said vertical second output shaft being driven from the first gear box to rotate said third and fourth horizontal output shafts, said second gear box also being provided with a vertical, upwardly extending, fifth output shaft in concentric relation to the vertical second output shaft, (viii) a pair of horizontally disposed gathering augers each in driven relationship with respect to one of said third and fourth output shafts, said gathering augers being supported to be in adjacent relation to the upper surface of the base, and each auger extending from a central position over the end of the discharge conduit access port to an outer edge position in intercepting and conveying relationship with respect to grain flowing from the grain column out from under the inner pervious wall, (ix)a third gear box above the second gear box and receiving an upper end of the vertical fifth output shaft, and (x) a torque arm anchored on one end with respect to the inner pervious wall and on the other end anchored to prevent rotational movement of the third gear box, the gearing of the third gear box being such that rotation of the vertical fifth output shaft will cause the second gear box to rotate about the common axis of the vertical second out shaft and the vertical fifth output shaft thereby causing the horizontal third and fourth output shafts and the gathering augers attached thereto to revolve about the concentric center of the inner pervious wall as they rotate on their own axes.

10. The grain dryer and conditioner of claim 9 wherein:

(n) means is provided to support the weight of the outer ends of the gathering augers as they rotate to carry grain to the discharge conduit access port and as they revolve about the that access port.

11. The grain dryer and conditioner of claim 7 wherein:

(1) the bottom end of the recycle collar is fixedly mounted in slightly spaced relation to the outer surface of the outer pervious wall to allow fines passing outwardly from the second grain column section through the outer pervious wall to pass between the bottom end of the recycle collar and the outer pervious wall into the recycle chamber adjacent the fourth grain column section.

12. The grain dryer and conditioner of claim 7 wherein:

(1) the bottom end of the impervous outer wall terminates in a downwardly and inwardly sloping ring-like skirt in intimate contact with the outer surface of the outer pervious wall;

(m) the outer pervious wall is provided at least at major intervals around its circumference with an inwardly and downwardly sloping flange in slightly spaced relation to the point of contact of the impervious outer wall skirt with the outer pervious wall; and (n) the outer pervious wall is also provided with an opening at least at major intervals around its circumference between the top edge of the flange and the point of its contact with the bottom edge of the impervious outer wall skirt, the size and positioning of the skirt, flange and opening being such that fines entering the recycle collar through the outer pervious wall will fall down the skirt and, by a venturi-like action, pass through the opening to be reincorporated into the grain column.

13. The grain dryer and conditioner of claim 7 wherein:

(1) a means is provided to approximate the average moisture content of the grain passing through the third and fourth grain column sections of the dryer as a function of the average temperature of that grain, said means including:

(i) a vertical channel member having its open face positioned against the inside surface of the inner pervious wall, said channel member having a closed upper end and an open lower end, the channel member extending from adjacent relation to an upper edge portion of the third grain column section to adjacent relation to a lower edge portion of the fourth grain column section, (ii) a temperature responsive probe positioned in the open, lower end portion of the channel member, (iii) remote means for representing a value of the temperature sensed by the probe, and (iv) conduit means between the probe and remote means for transmitting the temperature sensed by the probe to the remote means.

14. In a grain dryer and conditioner:

(1) including a base partially defined by a horizontal upper surface, (2) wherein a column of grain to be dried and conditioned is at least partially confined by a pair of ring-like, congruent, concentric, upright, spaced-apart, inner and outer pervious walls supported on and above the upper horizontal surface of the base, the inner wall effectively terminating at a ring-like, generally horizontal upper end surface, (3) wherein a top cone is positioned above the upright inner pervious wall to direct grain deposited on it to flow by gravity to the space between the upright pervious walls, (4) wherein means is provided to deliver grain to be dried and conditioned to fall on the top of the top cone, (5) wherein a grain side board extends upwardly from the outer pervious wall in position to support grain above the grain column so that grain falling from the top cone cannot get beyond the outer pervious wall, (6) wherein an upwardly blowing heater/blower assembly includes an impervious outer duct which is supported by bulkhead means at an intermediate position between the top and bottom of the upright pervious walls to be within and concentric with those walls, (7) wherein said bulkhead means includes a bulkhead baffle extending between a ring-like portion of the heater/blower assembly duct and a ring-like portion of the inner upright pervious wall in position to tend to block the return flow of heated air from the top of the heater/blower assembly duct back to the bottom of the duct inside of the inner pervious wall, the presence of bulkhead baffle thereby creating within the inner upright pervious wall a positively pressured upper heated plenum above the bulkhead baffle and a relatively negatively pressured lower mixing plenum below the bulkhead baffle, and (8) wherein means is provided to receive grain discharging from between the pervious walls at the bottom of the grain column and to deliver it to a place of storage and use.

the improvement wherein (a) an upright, impervious outer wall is supported in outwardly spaced concentric relation to said upright outer pervious wall to define, with at least part of that outer pervious wall, a recycle chamber for heated air, the upright impervious wall being partially defined by a ring-like top end effectively no higher than the height of the top end of the inner upright pervious wall and by a ring-like bottom end terminating at an intermediate location vertically positioned between the outer edge of the bulkhead baffle and the upper surface of the base;

(b) means is provided to approximate the average moisture content of the grain leaving the dryer as a function of the temperature of the grain passing through the grain column below the bulkhead baffle but before it encounters the cooling action of ambient air, said means including:

(i) a vertical channel member having its open face positioned against the inside surface of the impervious wall, said channel member having a closed upper end and an open lower end, the channel member extending from adjacent relation to the underside of the bulkhead baffle to adjacent relation to the bottom end of the impervious outer wall.

(ii) a temperature responsive probe positioned in the open, lower end portion of the channel member, (iii) remote means for representing a value of the temperature sensed by the probe, and (iv) conduit means between the probe and remote means for transmitting the temperature sensed by the probe to the remote means.

* * * * *

UNITED STATES PATENT AND TRADEMARK OFFICE

CERTIFICATE OF CORRECTION

PATENT NO. : 4,914,834

DATED : April 10, 1990

INVENTOR(S) : Sylvan H. Sime

It is certified that error appears in the above-identified patent and that said Letters Patent is hereby corrected as shown below:

Column 19, line 52, delete "Of" and insert --of--.

Column 21, line 2, after "conduit" insert --said first gear box being--.

Column 21, line 7, after "access" insert --port--.

Column 23, line 20, delete "wherein" and insert --wherein:--.

Signed and Sealed this

Eighth Day of October, 1991

*Attest:*

HARRY F. MANBECK, JR.

*Attesting Officer*

*Commissioner of Patents and Trademarks*